455-115
9/14/82 XR 4,349,170 SR

United States Patent [19]
Bilet et al.

[11] 4,349,170
[45] Sep. 14, 1982

[54] SAFETY CODING PROCESS FOR TRACK CIRCUITS

[75] Inventors: Claude D. Bilet, Boulogne Billancourt; Michel G. Guillard, Villejuif; Dominque A. Hedoin, Sceaux, all of France

[73] Assignee: Compagnie de Signaux et d'Entreprises Electriques, Paris, France

[21] Appl. No.: 102,431

[22] Filed: Dec. 11, 1979

[30] Foreign Application Priority Data

Dec. 22, 1978 [FR] France ..... 78 36270

[51] Int. Cl.[3] ..... B61L 3/20

[52] U.S. Cl. ..... 246/63; 246/28 F; 246/34 R; 246/63 R; 246/182 R; 455/115; 324/79 R

[58] Field of Search ..... 246/5, 28 F, 34 R, 63 R, 246/63 C, 167 R, 182 R, 182 B, 187 B; 371/68, 67, 69; 455/8, 9, 59, 115; 324/79 R; 318/607

[56] References Cited

U.S. PATENT DOCUMENTS 3,047,816 7/1962 Drake et al. ..... 331/49
3,268,727 8/1966 Shepard ..... 246/5
3,551,889 12/1970 Miller ..... 340/171
3,748,466 7/1973 Sibley et al. ..... 246/63 C
3,794,833 2/1974 Blazek et al. ..... 246/63 C
3,970,271 7/1976 Auer et al. ..... 246/34 R
4,002,314 1/1977 Barpal ..... 246/182 R
4,093,162 6/1978 Takaoka et al. ..... 246/187 B
4,133,504 1/1979 Dobler et al. ..... 246/187 B

*Primary Examiner*—Trygve M. Blix
*Assistant Examiner*—C. T. Bartz
*Attorney, Agent, or Firm*—Birch, Stewart, Kolasch & Birch

[57] ABSTRACT

A process for coding track circuits allows particularly information to be transmitted to a vehicle travelling over a railway track divided into a succession of sections each equipped with a track circuit, in which each of the carrier frequencies for energizing the track circuits is frequency modulated by means of a number of modulation frequencies each representing a piece of information to be transmitted. This process includes the steps of comparing the modulation frequency obtained by demodulation of the modulated carrier frequency with another source of modulation so as to check that said modulation frequency is indeed correct, and to allow transmission of the modulated carrier frequency in the corresponding track circuit only when this check is positive. This process and device applies to high-speed railway trains.

10 Claims, 2 Drawing Figures

SAFETY CODING PROCESS FOR TRACK CIRCUITS

BACKGROUND OF THE INVENTION

The present invention relates to a process for coding track circuits and particularly for allowing the transmission of information to a vehicle travelling on a railway track divided into a series of sections each equipped with a track circuit, in which each of the carrier frequencies for energizing the track circuits is frequency modulated by a number of modulation frequencies each representing a piece of information to be transmitted. The invention also relates to a transmitting device for implementing this process.

It is known that the safety and regularity of trains travelling over railway tracks are ensured by signals spaced along the tracks which serve to transmit information for receipt by the drivers of the trains.

At the present time, these signals are generally controlled automatically by safety devices, known under the name of track circuits, which ensure safety by the division of the track into sections, the track being divided into a series of sections each equipped with a track circuit. Of course, the division into sections must take into account the length of the trains, the speed of the fastest trains and the characteristics of the track, so as to guarantee the safety of spacing between successive vehicles.

In its most current version, the track circuit includes a transmitting member and a receiving member, each connected to the rails forming the track, so that the presence of a shunting axle located between the transmitting point and the receiving point on the track causes the de-energization of a relay associated with the receiver. When several track circuits succeed each other along the track, it is obviously indispensable that the signals transmitted in one of the track circuits cannot inopportunely energize the receiver of an adjacent track circuit. This requires the propagation of signals in each track circuit to be limited. This limitation may be achieved by using for example different frequencies or polarities for two consecutive track circuits or by limiting the propagation by means of insulating joints or by bandpass circuits equivalent to short circuits between the rails for the frequencies whose propagation it is desired to limit.

There now exists high speed trains where the driver only has very little time to notice a given signal, thus increasing the risks of accidents. Furthermore, with very high-speed trains, the use of visual signals for transmitting information to the driver is absolutely out of the question.

Furthermore, the appearance of locomotives with control of the motors by means of thyristors for AC drive and by means of choppers with DC drive cause the appearance in the current providing rails of parasite frequencies with high levels which are, either harmonics of the basic frequency of the drive current for AC, or harmonics of the control frequency of the choppers in the case of DC drive.

Attempts have been made to modulate the carrier frequencies of the signals for energizing the track circuits so as to, on the one hand, allow transmission on the track towards the machine and, on the other hand, provide efficient protection against the harmonics of the drive current.

Such a process for coding track circuits is described for example in French Pat. No. 70.00325 filed on Jan. 7, 1970 in the name of the Applicant company and published under the U.S. Pat. No. 2,076,219. According to this patent, the modulation frequencies are very low so that the modulation index is sufficiently high and, in a particular application, the energizing frequencies for the track circuits are of the order of a kilohertz, whereas the modulation frequencies are of the order of about ten hertz.

The different means for modulating, at transmission, the energizing frequencies of the different track circuits must naturally present a safety problem. In fact, the transformation of a modulating signal into another signal may be contrary to safety. It is therefore important to have a device which guarantees that the modulated carrier frequency is indeed modulating by the proper frequency. In present installations, it is possible to disturb the modulating signal, either by superposition of a parasite signal with the modulating signal, or by erratic cuts or short-circuits, due for example to the vibration of components or connections between the modulation source and the modulated member.

SUMMARY OF THE INVENTION

The principal arm of the present invention is therefore to remedy these disadvantages and thus the present invention provides a process for coding track circuits of the above-mentioned type. The modulation frequency, obtained by demodulation of the modulated carrier frequency, is compared with another source of modulation, so as to check that said modulation frequency is indeed correct, and to enable the transmission of the modulated carrier frequency in the corresponding track circuit only when this check is positive.

Thus, as will be readily understood, one can make sure that the energization of a track circuit takes place only if the modulation is indeed correct and corresponds effectively to the information which is desired to be transmitted. Such a process completely eliminates the risk of transmitting erroneous information likely to affect the safety of trains travelling over the track.

A transmission device for implementing this process comprises a first generator from which the modulation frequency corresponding to the piece of information to be transmitted is produced, a second generator from which a checking frequency is provided, a driver whose carrier frequency is modulated by said modulation frequency, a demodulator and an analog gate to which the modulated carrier frequency from the pilot is simultaneously applied to, and a comparator mixer for comparing the frequency from the demodulator with the checking frequency, the comparator mixer controlling, if necessary, the opening of the analog gate so as to allow transmission of the modulated carrier frequency to the corresponding track circuit.

In a particular embodiment of the invention, the checking frequency produces a constant frequency shift with respect to the modulation frequency whatever the information to be transmitted since the comparator mixer is essentially formed by a selective filter responsive to said frequency shift.

Preferably, the modulation frequency and the checking frequency are produced by corresponding generators by means of programmable dividers whose factor of division depends on the information to be transmitted.

In the case where the modulation frequencies are very low, as in the process described in the above-mentioned French patent, the programmable divider associated with the first generator is followed by a divider whose fixed division factor is equal to a power of two, whereas a multiplier whose factor of multiplication is equal to the same power of two is placed between the demodulator and the comparator mixer.

Preferably also, the transmitting device of the invention is constructed as two distinct modules, one of which is assigned to the coding and the checking of the information to be transmitted, whereas the other is assigned to the transmission itself, the transmitting module being capable of being used independently of the coding and checking module when it is not required to transmit information to vehicles travelling over the track.

Such an arrangement obviously allows a line to be equipped for a smaller cost and then the system may be completed easily when a track-machine connection proves to be necessary.

BRIEF DESCRIPTION OF THE DRAWINGS

An embodiment of the invention is described hereafter by way of example, with reference to the accompanying drawings in which.

DESCRIPTION OF THE PREFERRED EMBODIMENT

Figure 1:
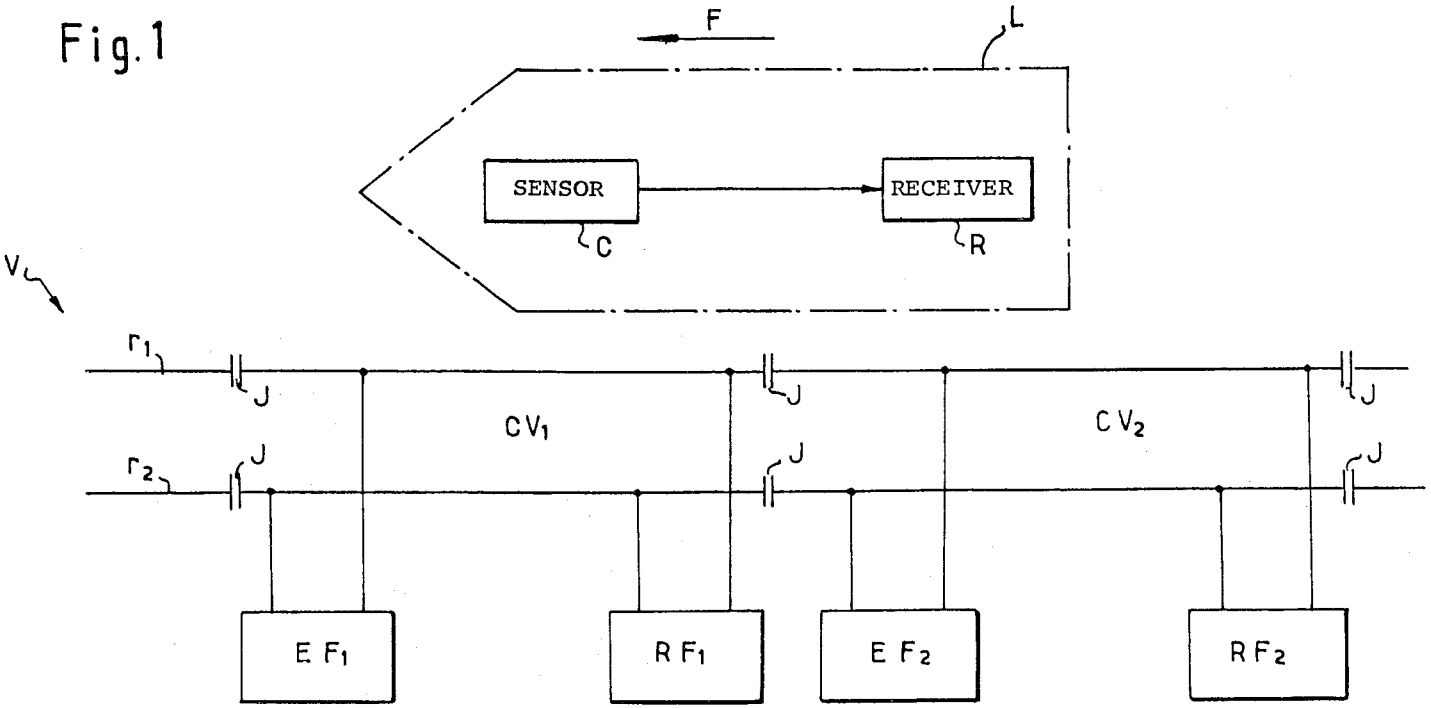
FIG. 1 is a simplified diagram of a part of a railway track equipped with track circuits.

Referring to FIG. 1, a portion of railway track V can be seen formed from two rows of rails $r_1$ and $r_2$. This railway track is equipped with successive track circuits $CV_1$, $CV_2$, etc . . . , energized by two different frequencies $F_1$ and $F_2$, for example 1700 Hz and 2300 Hz, which are repeated alternately along the length of the track. The successive track circuits aare insulated from each other by conventional insulating joints such as J, or by means of circuits equivalent to short-circuits for the frequencies considered.

In a way known per se, each track circuit comprises at one end a transmitter E at a frequency $F_1$ or $F_2$ and at the other end an appropriate receiver $RF_1$ or $RF_2$.

The purpose of the coding process to which the present invention relates is essentially to allow the transmission of information to vehicles such as L, generally a locomotive, travelling over the track V in the direction shown by arrow F. To this end, and as described in the above-mentioned French patent, each of the frequencies for energizing the track circuits is frequency modulated by means of a number of fixed very low modulation frequencies, each representing one of the pieces of information to be transmitted to the vehicle. If there are for example seven different pieces of information to be transmitted, these modulation frequencies may advantageously be between 12 Hz and 20 Hz. The modulation index is then relatively high. If we take for example a frequency deviation of $\pm 10$ Hz, we will have a modulation index between 0.5 and 0.8.

It should moreover be noted that because of the modulation, the carrier frequencies of 1700 Hz and 2300 Hz no longer appear in the track circuits. In fact, with a frequency deviation equal to $\pm 10$ Hz, there will be for example in a given track circuit, either 1690 Hz, or 1710 Hz, and this at the rate of the modulation frequency used at that moment, whereas in the two adjacent track circuits, there will be either 2290 Hz or 2310 Hz, still at the rate of the modulation frequency.

The means for sensing and detecting onboard the locomotive L detect the modulated frequencies generated in the successive track circuits so as to extract the information therefrom, and are essentially formed by a sensor C disposed in the vicinity of track V, preferably equidistant from the two lines of rails $r_1$ and $r_2$, followed by a receiver R similar to those equipping the track circuits.

In the present patent application, there will only be described the transmitting device E for modulating, in accordance with the present invention, the energization frequencies of the different track circuits, it being understood that the receiving means such as $RF_2$, $RF_2$ or R may be exactly of the same type as those described in French Pat. No. 70.00325 already mentioned.

Figure 2:
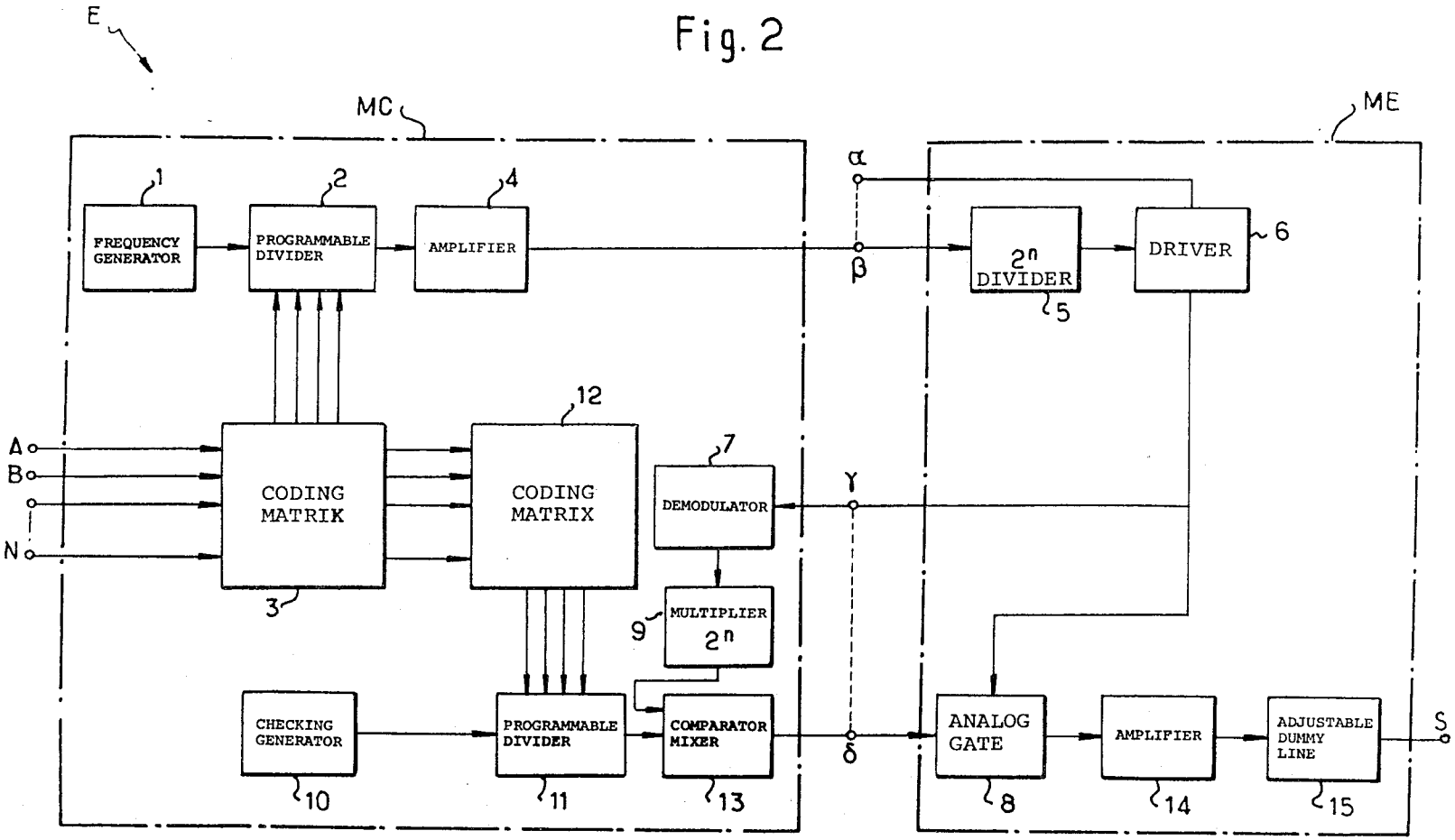
FIG. 2 is a block diagram of a transmitting device for the track circuit of the present invention.

This transmitting device E is shown as a block diagram in FIG. 2 and comprises first of all a driver generator 1 from which is provided the modulation frequency of the carrier at 1700 Hz or 2300 Hz. This generator, for example a quartz generator, is designed to generate a fixed and stable frequency which is then divided in a programmable divider 2 whose factor of division depends on the information to be transmitted. To this end, the single On-Off control is applied to one of the inputs A to N of a coding matrix 3, these inputs A to N representing the different pieces of information likely to be transmitted by the system and which may easily be 20 to 30 according to the needs. Matrix 3 then supplies to the programmable divider 2, according to the input terminal A, B or N which is activated, a logic signal determining the factor of division which will be applied to the signal from the pilot generator 1.

The programmable divider 2 is followed by an amplifier 4 serving as a separating stage and a divider 5 whose fixed factor of division is equal to $2^n$. This additional divider 5 is necessary because the modulation frequencies used in the process of the invention are very low, of the order of about 10 Hz, as we saw above. The frequency from divider 5 forms the modulation frequency representing the piece of information to be transmitted and it is applied to a driver 6 so as to modulate the carrier at 1700 Hz or 2300 Hz produced by this driver.

Thus there is obtained, at the output of driver 6, a frequency modulated signal characteristic of the piece of information to be transmitted to the locomotive L. It should however be recalled here that it is not really a question of a signal at 1700 Hz or 2300 Hz. In the case for example of 1700 Hz, there will simply be alternatively 1690 Hz and 1710 Hz, at the rate of the modulation frequency from divider 5.

This modulated signal is applied simultaneously to a demodulator 7 and to an analog gate 8 whose role will appear more clearly further on. Demodulator 7 detects the modulation frequency of the signal leaving driver 6 and this frequency is then multiplied in a multiplier 9 whose factor of multiplication is equal to $2^n$, so that the frequency of the signal appearing at the output of this multiplier is normally equal to that of the signal leaving the programmable divider 2. The transmitting device E comprises furthermore a checking generator 10 from which is provided a so-called checking frequency. This generator 10, which may also be a quartz generator like generator 1, is designed to generate a fixed stable frequency which is then applied to another programmable divider 11 associated with a second coding matrix 12 similar to matrix 3. Depending on the input terminal A, B or N which is activated by the single control, this coding matrix 12 generates a logic signal which determines the factor of division of programmable divider 11. Moreover, this factor of division is such that the frequency of the signal from divider 11 presents a constant frequency shift, for example 1000 Hz, with the frequency of the signal from divider 2. In other words, the signal from divider 2 must normally present the same frequency shift with the signal from multiplier 9. This is checked in a comparator-mixer 13 to which the two signals are simultaneously applied. In the present case, this comparator-mixer may be simply formed by a selective filter responsive to said frequency shift, i.e. 1000 Hz for example.

If the comparison of the two signals effected in the comparator-mixer 13 is correct, this latter supplies a signal which controls the opening of the analog gate 8, thus allowing the modulated signal generated by driver 6 to energize the corresponding track circuit. In the particular example described here, analog gate 8 is followed by a power amplifier 14 and an adjustable dummy line 15 serving as adapted. The output terminal S of the device may thus be connected to the rails of the track by means of a cable of any length, depending on the layout which obviously varies according to the line.

Thus it can be seen in short that with the transmitting device of the present invention, owing to the a posteriori checking of the modulation frequency, it is practically impossible to transmit a piece of erroneous information. It is in fact only upstream of driver 6 that disturbances of the modulating signal may possibly occur. Such a device presents accordingly great intrinsic safety, which is particularly desirable when it is a question of transmitting information to trains travelling at high speed.

Of course, the information supplied by the coding process of the present invention may also be used independently of the track-machine connection, when it is desired for example to reinforce the selectivity of the track circuit receivers. Mostly however such information is useless when there is no track-machine connection.

To this end and according to another characteristic of the invention, the transmitting device E is constructed in the form of two separate modules MC and ME. Module MC is assigned more specially to the coding and the checking of information and comprises all the elements required for these functions, whereas module ME is assigned to the transmission properly speaking.

The transmitting module ME thus comprises divider 5, driver 6, analog gate 8, power amplifier 14 and dummy line 15. This module is furthermore capable of operating independently of module MC. In fact, all that is required for that is to connect the input terminal $\alpha$ of divider 5 directly to the particular output terminal $\beta$ of driver 6 and to connect directly the normal output $\gamma$ of this same driver to the input terminal $\delta$ of analog gate 8. These two connections are illustrated by dotted lines in FIG. 2.

Thus there is provided a simplified transmitter capable of correctly energizing the track circuit with a frequency modulated signal, but whose modulation frequency is practically fixed and depends in fact essentially on the factor of division of divider 5. Lines or portions of lines may accordingly be equipped inexpensively with such transmitters and they may then be completed with coding modules MC when a track-machine connection is required.

We claim:

1. A system for producing a frequency modulated signal comprising:

input means for introducing information to be transmitted;

a generator producing a frequency generated signal;

programmable divider means for selectively dividing said frequency generated signal and producing an intermediate signal;

means responsive to said input means for selecting the division ratio of said divider means;

programmable frequency generating means responsive to said input means for generating a frequency check signal;

driver means for modulating a said intermediate signal produced by said programmable divider means to thereby produce an output signal;

operating means responsive to said frequency check signal and said output signal for producing an enabling signal when the difference between said frequency check signal and said output signal is equal to a single predetermined fixed frequency; and analog gate means responsive to said enabling signal produced by said operating means for delivering said output signal at the output of said analog gate means as the frequency modulated signal when said enabling signal is present.

2. The system of claim 1 wherein said operating means includes a mixer for mixing said frequency check signal and said output signal to produce a mixed signal; and comparator means for comparing the frequency of said mixed signal with said single predetermined fixed frequency, irrespective of said information being transmitted and producing said enable signal only when said frequencies are equal.

3. The system of claim 2 wherein said driver means comprises a frequency modulator.

4. The system of claim 3 wherein said driver means includes a supplemental divider means for converting said intermediate signal produced by said programmable divider means into a derived signal to be modulated.

5. The system of claim 4 wherein said operating means includes a demodulator and multiplier which demodulates and multiplies said output signal to produce a demodulated signal which is mixed with said frequency check signal to produce said mixed signal.

6. The system of claim 5 wherein said system is used to transmit information to railway vehicles within one of a plurality of track block circuits in a railway communications system.

7. The system of claim 6 wherein said driver means modulates said derived signal with a modulation frequency different from that used by the system connected to either of the adjacent track block circuits.

8. The system of claim 7 wherein said mixer means further comprises a selective filter responsive to said single fixed frequency.

9. The system of claim 8 wherein the division ratio of said supplemental divider means is a power of two, and wherein the ratio of said multiplier is a corresponding power of two.

10. The system of claim 1 wherein said system is constructed in two modules, one of said modules including said driver means and analog gate means and being operable alone when no information need be transmitted.

* * * * *